US005193492A

United States Patent [19]

Kawamura

[11] Patent Number: 5,193,492

[45] Date of Patent: Mar. 16, 1993

[54] 2-4 CYCLE CHANGE-OVER ENGINE AND ITS CONTROL SYSTEM

[75] Inventor: Hideo Kawamura, Kanagawa, Japan

[73] Assignee: Isuzu Ceramics Research Institute Co., Ltd., Kanagawa, Japan

[21] Appl. No.: 791,141

[22] Filed: Nov. 13, 1991

[30] Foreign Application Priority Data

Nov. 13, 1990 [JP] Japan ..... 2-306727
Nov. 13, 1990 [JP] Japan ..... 2-306728

[51] Int. Cl.[5] ..... F02B 69/06
[52] U.S. Cl. ..... 123/21; 123/90.11
[58] Field of Search ..... 123/21, 81 C, 80 C, 123/188 C, 65 VA, 90.11

[56] References Cited

U.S. PATENT DOCUMENTS

| | | | |
|---|---|---|---|
| 1,817,919 | 8/1991 | Highley . | |
| 2,810,373 | 10/1957 | Lang | 123/190.12 |
| 3,533,429 | 10/1970 | Shoulders | 123/188.5 |
| 4,635,590 | 1/1987 | Gerace | 123/190.1 |
| 5,005,539 | 4/1991 | Kawamura | 123/21 |
| 5,007,382 | 4/1991 | Kawamura | 123/21 |
| 5,022,353 | 6/1991 | Kamamura | 123/21 |
| 5,069,422 | 12/1991 | Kawamura | 123/90.11 |

FOREIGN PATENT DOCUMENTS

| | | |
|---|---|---|
| 0433039 | 6/1991 | European Pat. Off. . |
| 2485092 | 12/1981 | France . |

OTHER PUBLICATIONS

Abstract of JP-A-60 088 810, Patent Abstracts of Japan, vol. 9, No. 231 (M-414) (1954), Sep. 18, 1985.

*Primary Examiner*—David A. Okonsky
*Attorney, Agent, or Firm*—Staas & Halsey

[57] ABSTRACT

The present invention lies in a 2-4 cycle change-over engine and its control unit which perform 2 cycle running of the uniflow type by closing a suction valve at an upper portion of the engine and working a valve (a rotational sleeve) at a lower portion of a cylinder when the engine rotates in a lower number of revolution than a predetermined number of revolution and a load is larger than a predetermined value, and perform change-over into 4-cycle running by always closing a scavenging port at a lower portion of the cylinder by means of the valve (the rotational sleeve) at the lower portion of the cylinder and working the suction valve at the upper portion of the cylinder when a higher revolution than a predetermined number of revolution is given and an engine load is lighter than a predetermined load.

3 Claims, 2 Drawing Sheets

2–4 CYCLE CHANGE-OVER ENGINE AND ITS CONTROL SYSTEM

BACKGROUND OF THE INVENTION

1. Field of the Invention

The present invention relates to a 2–4 cycle change-over engine and its control unit which perform 2 cycle running in the case of a low revolution of the engine and perform change-over into 4 cycle running in the case of a high revolution.

2. Description of the Prior Art

Ordinary engines are generally classified into the 2 cycle engine which performs steps of suction, compression, explosion and exhaust during 2 strokes of a piston which performs reciprocal movement that is one rotation of a crank shaft, and the 4 cycle engine which performs the above mentioned 4 steps during 4 strokes of a piston that is 2 rotations of a crank shaft.

And in the 2 cycle engine of the uniflow type, a suction port is arranged at a lower portion of a cylinder liner, suction and exhaust are performed at the same time with air sent by pressure during the descending stroke of the piston, and explosion is made very time when the crank shaft performs one revolution, so that rotational variation in an output shaft in less and a high torque can be generated, while in the 4 cycle engine, suction and exhaust are performed in independent strokes respectively, so that the energy consumption ratio is less as compared with the 2 cycle engine.

By the way, in case of running one engine with switching into the 2 cycle running or the 4 cycle running, there is the suction port for the case of 2 cycle running at the lower portion of the cylinder liner, so that there is such a problem that the interior of the cylinder communicates with the exterior when the piston performs the descending stroke during the 4 cycle running.

Thus, a means for closing the suction port at the lower portion may be provided during the 4 cycle running, however, when opening and closing of the suction port is dependent on the ascending and descending movement of the piston, there is limitation at an upper edge position of an opening portion of the suction port in order to provide a sufficient compression ratio, so that there is such a problem that the stroke cannot be made so large.

The present invention has been done taking such problems into consideration, an object of which is to provide a 2–4 cycle change-over engine and its control unit which can be easily switched into the 2 cycle running or the 4 cycle running in accordance with revolution of an engine in order to perform efficient running.

SUMMARY OF THE INVENTION

In order to achieve the above mentioned object, according to the present invention, there is provided a 2–4 cycle change-over engine having suction ports which are provide at a lower portion of a cylinder, a cylindrical rotational sleeve which has a suction window for opening the suction ports and is provided with plural individuals of permanent magnets for rotational driving at the periphery at equal intervals so as to closely contact with the cylindrical surface of the cylinder to rotate, a rotational driving means which allows the rotational sleeve to rotate during revolution of the engine by means of mutual attraction and repulsion force between the magnetic flux generated by it and the magnetic flux of the above mentioned permanent magnets, and a driving control means which performs position control of the rotational sleeve to a position at which the suction window is not coincided with the suction port in the vicinity of the lower dead center of a piston during the 4 cycle running, and allows the suction port of the cylinder to communicate with the suction window of the rotational sleeve at a suction timing during the 2 cycle running.

And in this 2–4 cycle change-over engine, the cylindrical rotational sleeve which has the embedded permanent magnets as driven means and the suction window is arranged at the portion of the suction ports at the lower portion of the cylinder, and the rotational sleeve is allowed to always rotate and drive in the circumferential direction by a driving motor in accordance with the engine revolution and the load so as to open and close the suction ports to control, so that opening of the suction port is performed in harmony with the timing of the engine revolution during the suction stroke in the 2 cycle running, and in the 4 cycle running, control can be performed so as to close the suction port, so that change-over of a state of the 2 cycle or 4 cycle running is carried out smoothly and certainly.

In addition, the rotational sleeve in which the permanent magnets are distributed at whole periphery is electromagnetically rotated and driven by means of the driving motor, so that the speed of the rotational sleeve can be locally changed in accordance with the revolution of the engine, and the control of the opening period of the suction port can be freely carried out. And when a detected value from a means for detecting a number of revolution of the engine is lower than a predetermined number of revolution and a detected value from a load detecting means is larger than a predetermined value, then a suction value at an upper portion of the engine is closed, and the rotational sleeve is worked to perform the 2 cycle running, and when a detected value from the above mentioned means for detecting a number of revolution is a higher revolution than a predetermined number of revolution, and a detected value from the load detecting means is lighter than a predetermined value, then a scavenging port at a lower portion of the cylinder is always closed by means of the rotational sleeve, and suction and exhaust valves at the upper portion of the cylinder are worked to perform the 4 cycle running.

As described above, according to the present invention, the suction ports for the 2 cycle running provided at the lower portion of the cylinder are controlled to synchronize the timing so as to be opened by the suction window of the rotational sleeve which is driven in the same revolution during the 2 cycle running, which are in a timing to be closed during the 4 cycle running, so that there is such an advantage that switching between the 2 cycle and the 4 cycle is performed smoothly and easily, and there is no dependence on the ascending and descending movement of the piston, so that influences on a compression ratio and the like can be avoided.

In addition, in the present invention, the magnets as the drives means are distributed at the whole periphery of the rotational sleeve, and a magnet for position determination is further arranged at a predetermined place, so that establishment of timing at the position of the suction window is performed with ease, and the local change in the rotational speed of the rotational sleeve can be controlled, and an opening/closing period of the suction port in adaptation to the engine rotation can be freely controlled.

DESCRIPTION OF THE PREFERRED EMBODIMENTS

Next, an example of the present invention will be explained in detail with reference to the drawings.

Figure 2:
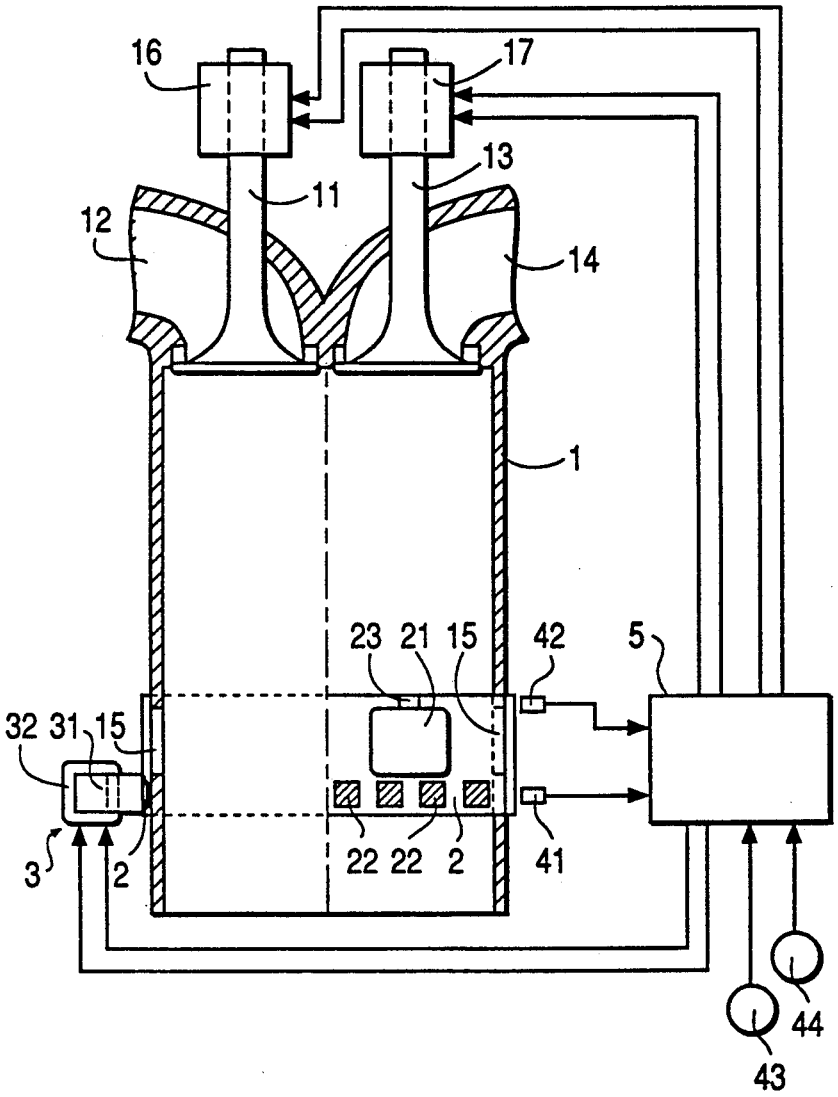
FIG. 2 is a figure of construction showing a partial cross section of the 2–4 cycle change-over engine and its control unit according to the present invention.
Figure 3:
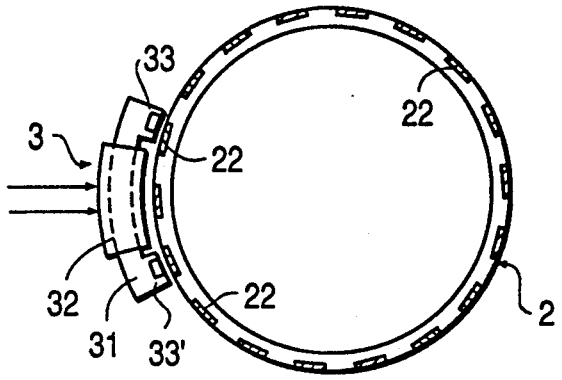
FIG. 3 is a lateral cross sectional view of the rotational sleeve thereof.

FIG. 2 is a block diagram of construction showing an example of the control unit of the 2–4 cycle change-over engine according to the present invention, and FIG. 3 is a figure for explanation of an example of the rotational sleeve thereof.

In these drawings, 1 is a cylindrical cylinder at an upper portion of which are formed a suction flow passage 12 provided with a suction valve 11 and an exhaust flow passage 14 provided with an exhaust valve 13, and through the peripheral wall of the cylinder 1 in the vicinity of an upper portion of a piston head at the position of the lower dead center of the piston are provided a plurality of suction ports 15 at each predetermined interval to penetrate, so as to be constructed to provide a suction passage during the 2 cycle running.

2 is a cylindrical rotational sleeve having a thin wall thickness, which is freely fitted to the outer periphery of a portion of the suction ports 15 of the cylinder 1, and a suction window 21 is provided at a portion corresponding to positions of the suction ports 15 so as to form the suction passage, which is also constituted such that the suction ports 15 are covered by means of movement by a predetermined angle toward the circumferential direction.

22 are permanent magnets for constituting a part of a rotational driving means embedded at equal intervals along the whole periphery of the surface of the rotational sleeve 2, which drive the rotational sleeve 2 by means of a magnetic function of attraction and repulsion with respect to a driving motor 3 as described hereinafter.

A magnetism detecting device 41 is arranged closely near the permanent magnets 22 embedded in the rotational sleeve 2, which detects the magnetism when each permanent magnet 22 passes through the front face of the magnetism detecting device 41, and a detected signal thereof is sent to a controller 5 as described hereinafter. Although the detected signal to be sent to the controller 5 is in a state of sine wave, it is subjected to waveform shaping in the controller 5 to be a pulse signal.

At a predetermined position at the upper side of the suction window 21 opened at the rotational sleeve 22 is embedded one magnet 23, and a magnetism detecting device 42 is provided with opposing to the magnet 23, and this magnetism detecting device 42 detects passing of the magnet 23. This detected signal is sent to the controller 5, which is subjected to waveform shaping.

Incidentally, position detection and detection of the rotational speed of the rotational sleeve 2 are generally performed as follows.

At first, passing of the magnet 23 is detected by the magnetism detecting device 42 to know an initial position of the rotational sleeve 2. In accordance with this detected signal, a counter (not shown), which counts the number of pulse signals detected by the magnetism detecting device 41, is cleared to "0" in the controller. Then, the number of pulse signals detected by the magnetism detecting device 41 is counted to detect a rotational position of the rotational sleeve 2 that is a position of the suction window 21.

In addition, by counting the number of the above mentioned pulse signals generated in a unit period of time, a rotational speed of the rotational sleeve 2 is detected.

The driving motor 3 has an arc-shaped core portion 31 and a coil portion 32, wherein magnetic poles 33, 33' at both ends of the core portion 31 are arranged closely near the permanent magnets 22 of the above mentioned rotational sleeve 2, and an electric current of a predetermined waveform is applied to the coil portion 31, whereby the rotational sleeve 2 is driven in the outer peripheral direction of the cylinder 1, and the electric current for driving is supplied form the controller 5 as described hereinafter.

The suction valve 11 and the exhaust valve 13 are electromagnetically driven upward and downward by means of valve driving mechanisms 16 and 17 respectively so as to perform valve opening/closing, and there is given such a construction that in instruction for the valve opening/closing is instructed from the controller 5 in accordance with the cycle number. Incidentally, 45 is a piston position sensor which detects a position of a crank shaft to detect the upper and lower dead centers of the piston.

The controller 5 comprises a microcomputer, which is provided with a central control unit for performing arithmetic processing, various memories for storing procedures of the arithmetic processing, procedures of the control and the like, input/output ports and the like. And it is constituted such that in accordance with signals from a revolution sensor 43 for detecting the number of revolution of the engine, a load sensor 44 for detecting an engine load and the like, instructions are sent to the valve driving mechanism 16, 17 and the driving motor 3 to perform opening and closing of the suction valve 11 and the exhaust valve 13 and driving of the rotational sleeve 2 in the outer peripheral direction of the cylinder, and attention is given to the driving speed of the rotational sleeve 2 in accordance with signals from the magnetism detecting devices 41 and 42 and the timing of opening of the suction ports 15 by means of the suction window 21 in rotation.

Figure 1:
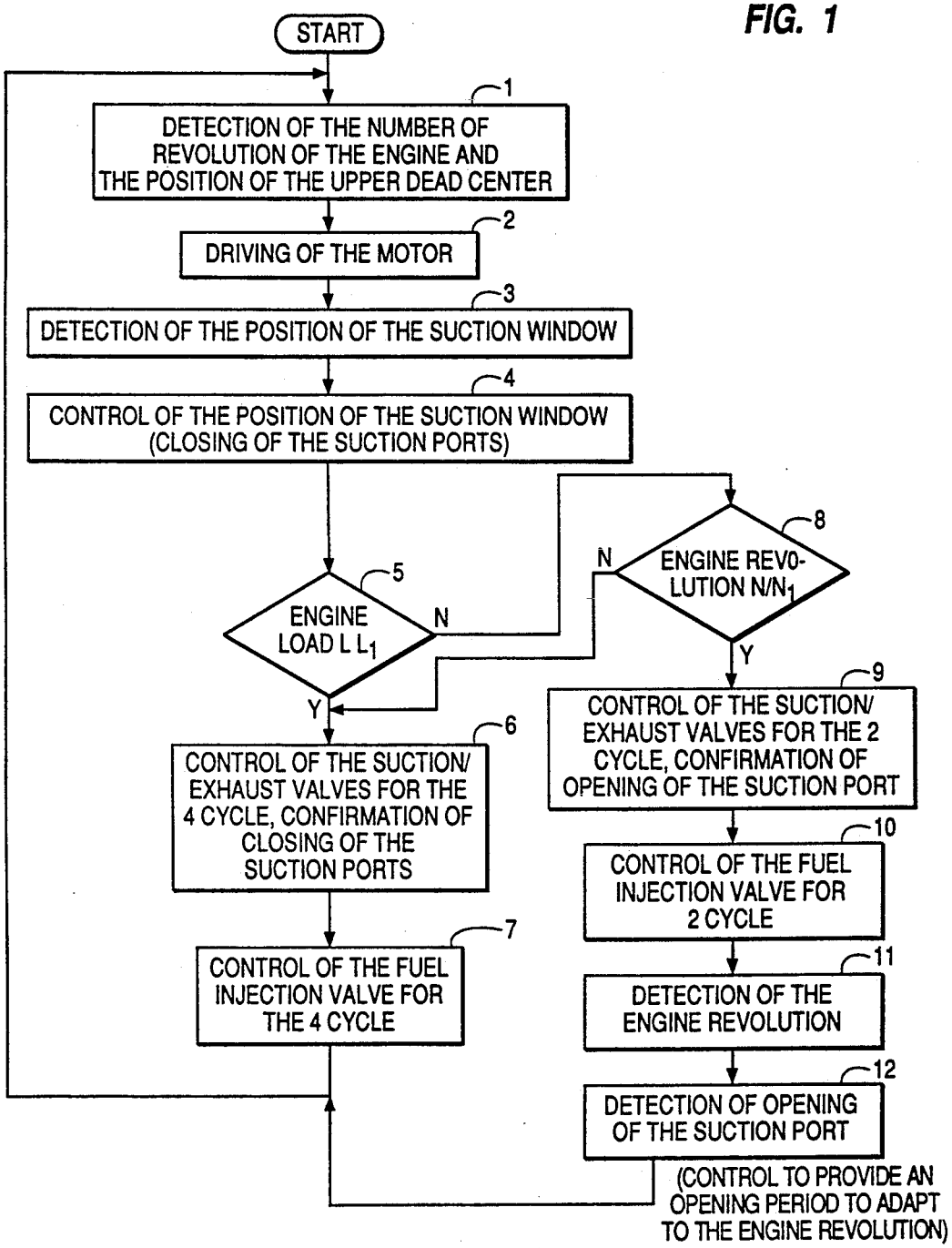
FIG. 1 is a process flow chart showing an example of working of the present example.

FIG.1 is a process flow chart showing an example of working of the present invention, and the working of the present example will be explained on the basis of the same figure.

At first, in the step 1, signals form the revolution sensor 43 and the piston position sensor 45 are read, and the number of revolution of the engine and the position of the upper dead center of the piston are checked.

In the step 2, an electric current is applied to the driving motor 3 so as to allow the rotational sleeve 2 to rotate and drive in the same manner as the revolution of the engine. And in the step 3, in accordance with detected signals of the magnetism detecting devices 41, 42 is detected the position of the suction window 2 provided at the rotational sleeve 2, and control is performed in the step 4 to deviate the timing such that the suction window 21 and the suction ports of the cylinder 1 are not in coincidence at the position of the lower dead center of the piston so as not to open.

In the step 5, the engine load is checked in accordance with a signal from the load sensor 44, and after comparison with a previously established load $L_1$, when L from the load sensor is small, progress to the step 6 is performed, or when L is larger than $L_1$, progress to the step 8 is performed.

When the load L is small, the suction valve 11 and the exhaust valve 13 at the upper portion of the cylinder are subjected to opening and closing control for the 4 cycle running in the step 6 by means of the valve driving mechanism of each of them, and closing of the suction ports 15 by the rotational sleeve 2 is confirmed by signals from the magnetism detecting devices 41, 42. And then in the step 7, fuel injection into the engine is controlled for the 4 cycle to perform running.

On the other hand, when the engine load L is larger than a predetermined value $L_1$, progress to the step 8 is performed, however, a signal of the number of revolution N from the revolution sensor 43 is compared with a predetermined number of revolution $N_1$ herein. And when N is smaller than the predetermined value $N_1$, progress to the step 9 is performed, and the suction valve 11 is stopped so as to adapt to the 2 cycle running, while the exhaust valve 13 is subjected to opening and closing control so as to be opened at the position of the lower dead center. Incidentally, the suction ports 15 of the cylinder 1 are controlled in a timing to be opened at the position of the lower dead center by the suction window 21 of the rotational sleeve 2.

Next, in the step 10, the fuel injection is controlled for the 2 cycle running, and in the step 11, the number of revolution of the engine is checked in accordance with a signal from the revolution sensor 43, and the rotational speed of the rotational sleeve 2 is locally changed so as to obtain an opening period to adapt to the number of revolution of the engine, and control is performed such that the coincidence time of the suction ports 15 and the suction window 21 is controlled.

As described above, the present invention has been explained in accordance with the example, however, various modifications are possible within the gist of the present invention, and these modifications are not excluded from the scope of the present invention.

I claim:

1. A sleeve valve system for a 2–4 cycle engine having a change-over between 2 cycle and 4 cycle operation, comprising:

a plurality of suction ports provided at a lower portion of a cylinder of the engine;

a cylindrical rotational sleeve having a suction window for opening one of said suction ports and provided with a plurality of permanent magnets at the periphery of said sleeve at equal intervals for rotatively driving said sleeve while held in contact with an outer cylindrical surface of said cylinder;

rotational driving means for causing said sleeve to rotate during revolution of the engine by means of mutual attraction and repulsion to said permanent magnets; and driving control means for controlling a rotational position of said sleeve to prevent the suction window from coinciding with one of said suction ports during 4 cycle operation, and align the one of said suction ports with the suction window at a suction timing during 2 cycle operation.

2. The sleeve valve system according to claim 1, wherein said driving control means controls a rotational speed of said sleeve in dependence upon a number of revolutions of the engine so that a duration of the period in which the suction window coincides with one of said suction ports may be selectively controlled.

3. A control unit for a sleeve valve system in a 2–4 cycle engine provided with a plurality of suction ports at a lower portion of a cylinder, a cylindrical rotational sleeve having a suction window for opening one of the suction ports and a plurality of permanent magnets at the periphery of the sleeve at equal intervals for rotatively driving the sleeve while held in contact with an outer cylindrical surface of the cylinder, rotational driving means for causing the sleeve to rotate during revolution of the engine by means of mutual attraction and repulsion to said permanent magnets, and driving control means for controlling a rotational position of said sleeve to prevent the suction window from coinciding with one of said suction ports during 4 cycle operation, and align the one of said suction ports with the suction window at a suction timing during 2 cycle operation, comprising:

means for detecting a number of revolutions of the engine;

load detecting means for detecting a load on the engine; and driving means for controlling 2 cycle operation by closing a suction valve at an upper portion of the cylinder and operating the sleeve when the number of revolutions is less than a first predetermined value and the load on the engine is greater than a second predetermined value, and for controlling 4 cycle operation by maintaining a closed position of a scavenging port at a lower portion of the cylinder by positioning of the sleeve and operating suction and exhaust valves at an upper portion of the cylinder when the number of revolutions is greater than a third predetermined value and the load on the engine is less than a fourth predetermined value.

* * * * *